US011749242B2

(12) United States Patent
Oba et al.

(10) Patent No.: US 11,749,242 B2
(45) Date of Patent: Sep. 5, 2023

(54) SIGNAL PROCESSING DEVICE AND SIGNAL PROCESSING METHOD

(71) Applicant: YAMAHA CORPORATION, Hamamatsu (JP)

(72) Inventors: Yasuhiko Oba, Hamamatsu (JP); Masafumi Nakata, Hamamatsu (JP); Noriaki Matsuo, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 415 days.

(21) Appl. No.: 16/950,103

(22) Filed: Nov. 17, 2020

(65) Prior Publication Data

US 2021/0074251 A1 Mar. 11, 2021

Related U.S. Application Data

(63) Continuation of application No. PCT/JP2018/019294, filed on May 18, 2018.

(51) Int. Cl.

| | |
|---|---|
| ***G10H 1/053*** | (2006.01) |
| ***G10H 1/00*** | (2006.01) |
| ***G10H 1/34*** | (2006.01) |

(52) U.S. Cl.

CPC ..... *G10H 1/053* (2013.01); *G10H 1/0008* (2013.01); *G10H 1/344* (2013.01); *G10H 2220/221* (2013.01)

(58) Field of Classification Search

CPC ..... G10H 1/053; G10H 1/0008; G10H 1/344; G10H 2220/221

USPC ..... 84/626

See application file for complete search history.

(56) References Cited

U.S. PATENT DOCUMENTS

| | | | | |
|---|---|---|---|---|
| 4,899,631 A * | 2/1990 | Baker | G10H 1/346 | 84/439 |
| 5,453,571 A * | 9/1995 | Adachi | G10H 1/053 | 84/626 |
| 7,309,828 B2 * | 12/2007 | Ludwig | G06F 3/04847 | 84/622 |
| 8,530,736 B2 * | 9/2013 | Liu | G10H 5/007 | 703/2 |

(Continued)

FOREIGN PATENT DOCUMENTS

| | | | |
|---|---|---|---|
| EP | 3633668 A1 * | 4/2020 | G10H 1/0008 |
| JP | H06130962 A * | 5/1994 | |

(Continued)

OTHER PUBLICATIONS

Office Action issued in Japanese Appln. No. 2020-518925 dated Oct. 19, 2021. English machine translation provided.

(Continued)

*Primary Examiner* — Christina M Schreiber
(74) *Attorney, Agent, or Firm* — ROSSI, KIMMS & McDOWELL LLP

(57) ABSTRACT

A signal processing method according to an embodiment of the present disclosure includes outputting a second sound signal by varying a level of a portion of a band of a first sound signal based on a second parameter corresponding to a displacement of each of a plurality of operators, the first sound signal being identified by a first parameter corresponding to the displacement, the second parameter being different from the first parameter.

20 Claims, 11 Drawing Sheets

(56) References Cited

U.S. PATENT DOCUMENTS

| | | | | |
|---|---|---|---|---|
| 2002/0184989 | A1* | 12/2002 | Meisel | G10H 1/0555 84/216 |
| 2010/0307322 | A1* | 12/2010 | Tominaga | G10H 5/007 84/622 |
| 2015/0206521 | A1* | 7/2015 | Sexton | G10H 3/146 84/609 |
| 2018/0261196 | A1* | 9/2018 | Tajika | G10H 1/0091 |
| 2020/0005746 | A1* | 1/2020 | Nishida | G10H 7/02 |
| 2020/0005747 | A1* | 1/2020 | Nishida | G10H 1/346 |
| 2020/0126526 | A1* | 4/2020 | Sato | G10H 1/053 |
| 2020/0193949 | A1* | 6/2020 | Tanoue | G10H 1/348 |
| 2020/0312288 | A1* | 10/2020 | Sato | G10H 1/0091 |
| 2021/0074251 | A1* | 3/2021 | Oba | G10H 1/46 |
| 2021/0295810 | A1* | 9/2021 | Sasaki | G10H 1/344 |

FOREIGN PATENT DOCUMENTS

| | | | | |
|---|---|---|---|---|
| JP | H06130962 | A | | 5/1994 |
| JP | 2004309811 | A | * | 11/2004 |
| JP | 2007248593 | A | * | 9/2007 |
| JP | 2007248593 | A | | 9/2007 |
| JP | 2011253040 | A | * | 12/2011 |
| JP | 2011253040 | A | | 12/2011 |
| JP | 6040662 | B2 | | 12/2016 |
| JP | WO2019159259 | A1 | * | 1/2021 |

OTHER PUBLICATIONS

English translation of Written Opinion issued in Intl. Appln. No. PCT/JP2018/019294 dated Aug. 7, 2018, previously cited in IDS filed Nov. 17, 2020.

International Search Report issued in Intl. Appln. No. PCT/JP2018/019294 dated Aug. 7, 2018. English translation provided.

Written Opinion issued in Intl. Appln. No. PCT/JP2018/019294 dated Aug. 7, 2018.

* cited by examiner

SIGNAL PROCESSING DEVICE AND SIGNAL PROCESSING METHOD

CROSS REFERENCE TO RELATED APPLICATIONS

This application is based upon and claims the benefit of priority from the prior PCT Application No. PCT/JP2018/019294 filed on May 18, 2018, the entire contents of which are incorporated herein by reference.

FIELD

The present disclosure relates to a technique for changing a sound according to operation.

BACKGROUND

In addition to a string hitting sound, Japanese Patent No. 6,040,662 discloses an electronic piano that produce a sound that reproduce a key bed impact sound that occur with key depression. In the technique described in Japanese Patent No. 6,040,662, a plurality of sound waveform data for generating a hammer string hitting sound and a plurality of collisional waveform data for generating a key bed impact sound are stored in a waveform memory inside a sound source.

DESCRIPTION OF EMBODIMENTS

Figure 1:
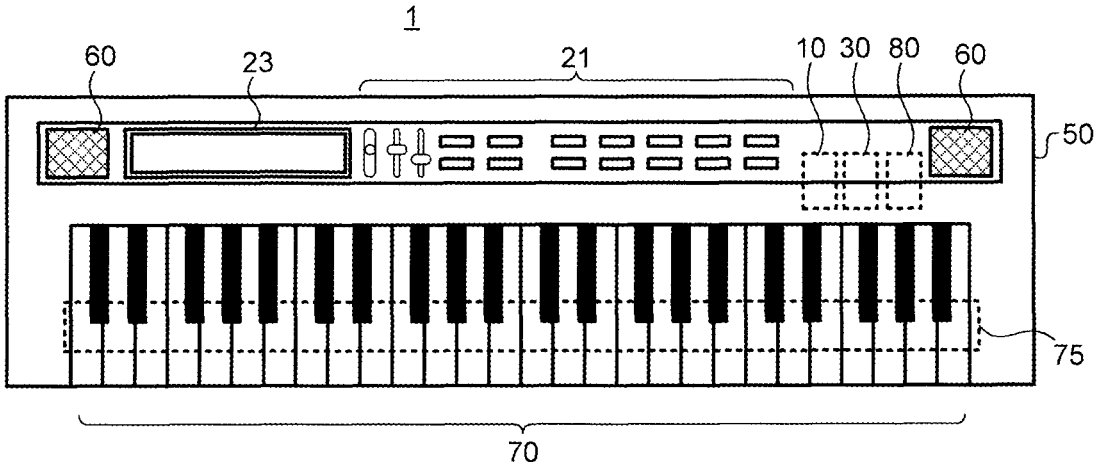
FIG. 1 is a diagram showing a configuration of an electronic keyboard instrument according to an embodiment of the present disclosure.

An electronic piano of Japanese Patent No. 6,040,662 separately stores waveform data of respective sounds of a hammer string hitting sound and a key bed impact sound obtained by sampling. This electronic piano generates a sound signal based on the stored waveform data of the hammer string hitting sound and the stored waveform data of the key bed impact sound. The technique of Japanese Patent No. 6,040,662 requires separate sampling of the hammer string hitting sound and the key bed impact sound in advance.

According to the present disclosure, even when the waveform data of each sound of a plurality of sounds is not used, it is possible to provide a technique for adjusting a sound generated in response to an operation of an operator.

An electronic keyboard instrument according to an embodiment of the present disclosure will be described below referring to drawings. Following embodiments are examples of embodiments of the present disclosure, and the present disclosure is not to be construed as being limited to these embodiments. In the drawings referred to in the present embodiments, the same portions or portions having similar functions are denoted by the identical signs or similar signs (signs each formed simply by adding A, B, etc. to the end of a number), and a repetitive description thereof may be omitted.

FIG. 1 is a diagram showing a configuration of an electronic keyboard instrument 1 according to an embodiment of the present disclosure. The electronic keyboard instrument 1 is an exemplary keyboard instrument having a plurality of keys 70. The key 70 is an example of an operator operated by a user to instruct to make a sound. When the user presses the key 70 (that is, key depression), a position of the key 70 changes, and a sound is generated from a speaker 60. Each of the plurality of keys 70 corresponds to different pitches of a string hitting sound of an acoustic keyboard instrument. The type of sound (timbre) to be generated is changed by using an operation unit 21. The electronic keyboard instrument 1 is, for example, an electronic piano. The electronic keyboard instrument 1 can generate a sound close to an acoustic piano when generating in the tone of a piano. In particular, the electronic keyboard instrument 1 can reproduce the key bed impact sound in addition to the string hitting sound. The key bed impact sound means a sound generated by transmitting an impact when a key reaches a stroke end at the time of key depression on the key bed in the acoustic piano.

The plurality of keys 70 is rotatably supported by a housing 50. The operation unit 21, a display unit 23, and the speaker 60 are supported by the housing 50. A control unit 10, a storage unit 30, a detecting unit 75, and a sound source 80 are arranged inside the housing 50. The electronic keyboard instrument 1 may further include an interface for inputting and outputting signals to and from an external device. The interface may include, for example, a terminal for outputting the sound signal to the external device, and a cable connecting terminal for transmitting and receiving data in MIDI™ format.

Figure 2:
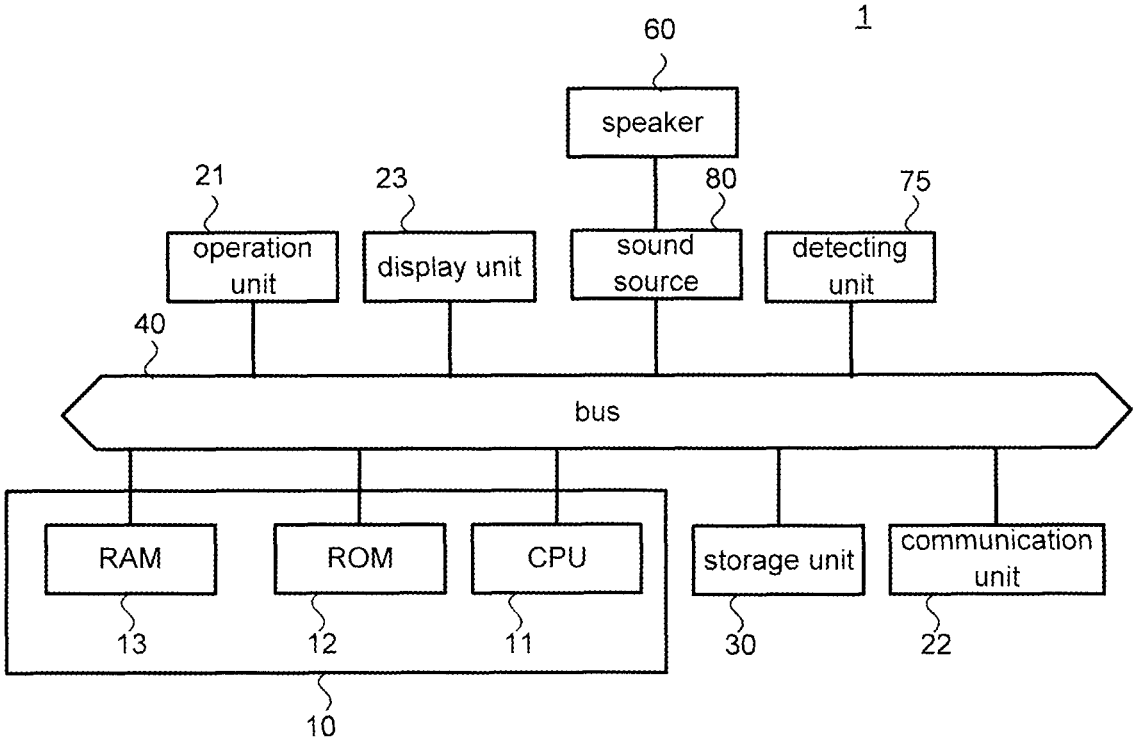
FIG. 2 is a block diagram showing a configuration of an electronic keyboard instrument according to an embodiment of the present disclosure.

FIG. 2 is a block diagram showing a configuration of the electronic keyboard instrument 1. The electronic keyboard instrument 1 includes the control unit 10 for controlling operation of the electronic keyboard instrument 1. The control unit 10 is electrically connected to each of the storage unit 30, a communication unit 22, the operation unit 21, the display unit 23, the sound source 80, and the detecting unit 75 via a bus (data bus and address bus) 40. The sound source 80 is electrically connected to the speaker 60.

In the control unit 10, a ROM 12 stores various computer programs executed by a CPU 11, various table data referred to when the CPU 11 executes a predetermined computer program, and the like in a readable manner. A RAM 13 is used as a working memory for temporarily storing various data and the like generated when the CPU 11 executes a predetermined computer program. Alternatively, the RAM 13 may be used as a memory for temporarily storing a computer program being executed or related data thereof.

The operation unit 21 includes, for example, operating buttons, touch sensors and sliders. The display unit 23 includes, for example, a liquid crystal display device or an OLED display device. The display unit 23 displays a control state of the electronic keyboard instrument 1, information related to a setting and control set via the operation unit 31, and the like. The speaker 60 emits a sound corresponding to the sound signal from the sound source 80. The communication unit 22 is an interface for transmitting and receiving a control program, related data thereof, event information corresponding to a performance operation, and the like between the electronic keyboard instrument 1 and an external device (e.g., a server or an MIDI device) that is not shown. The communication unit 22 may be, for example, an interface such as a MIDI interface, a LAN, the Internet, a telephone line, or the like. The communication unit 22 may be a wired interface or a wireless interface.

The storage unit 30 stores various application programs, various related data thereof, and the like. In addition to the control program, the storage unit 30 stores a table and a parameter used, for example, in the sound source 80. The waveform data is data (digital data) showing the waveform of the sound. The parameter is for adjusting the sound signal generated based on the waveform data. The storage unit 30 is, for example, a nonvolatile memory. The sound source 80 is an example of a signal processing device for performing a signal processing for sound generation. The speaker 60 generates a sound in accordance with the sound signal output from the sound source 80.

The detecting unit 75 detects positions of each of the plurality of keys 70 (i.e., positions in a depression area). The detecting unit 75 includes a plurality of sensors provided corresponding to the positions of each of the plurality of keys 70. The detecting unit 75 outputs information indicating the pressed key 70 and information indicating the positions of the key 70 in association with each other.

Figure 3:
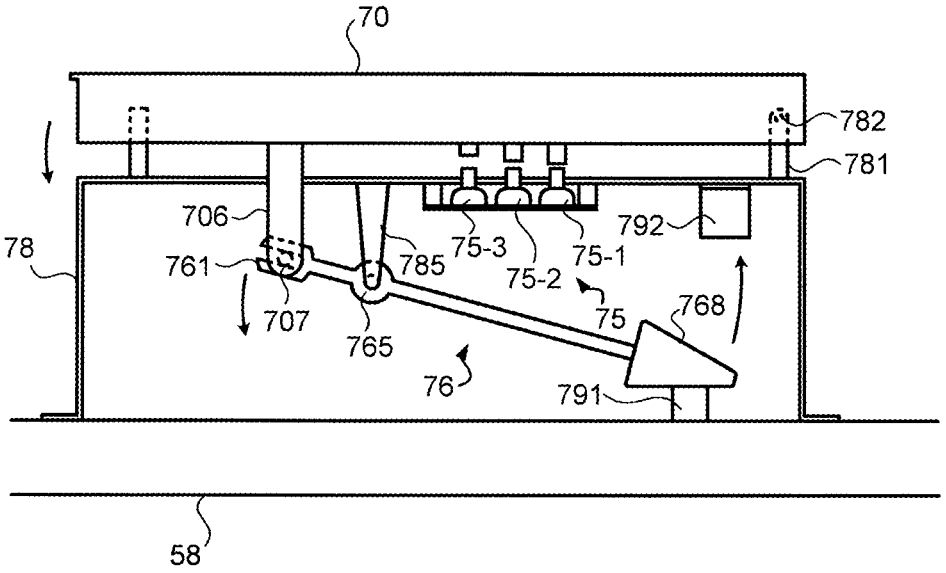
FIG. 3 is a diagram showing an internal configuration of an electronic keyboard instrument (key assembly) in an embodiment of the present disclosure.

FIG. 3 is a diagram showing a configuration of inside the electronic keyboard instrument 1 (keyboard assembly). FIG. 3 shows a cross-section of the electronic keyboard instrument 1 when the electronic keyboard instrument 1 is cut in a plane intersecting a direction in which the plurality of keys 70 is arranged. FIG. 3 shows a configuration relating to a white key among the plurality of keys 70.

A key bed 58 is a member that forms a part of the housing 50. A frame 78 is fixed to an upper surface of the key bed 58. A key support member 781 is arranged on an upper plate portion of the frame 78 and protrudes upward from the frame 78. The key support member 781 rotatably supports the key 70 about a shaft 782. A hammer support member 785 is arranged on the upper plate portion of the frame 78 and protrudes downward. A hammer 76 is arranged on the opposite side of the key 70 with the upper plate portion of the frame 78 interposed therebetween. The hammer support member 785 rotatably supports the hammer 76 about a shaft 765. The hammer 76 has a key connection unit 761 at one end on the shaft 765.

A hammer connecting unit 706 is arranged on a lower surface of the key 70 and protrudes downward the key 70. The hammer connecting unit 706 includes a coupling unit 707 at the lower end. The coupling unit 707 and the key connection unit 761 are connected to slidable. The hammer 76 includes a weight 768 at the other end of the shaft 765. When the key 70 is not operated, the weight 768 is placed on a lower limit stopper 791 by its own weight.

When the key 70 is depressed, the key connection unit 761 moves downward. As the key connection unit 761 moves, the hammer 76 rotate, and the weight 768 moves upward. When the weight 768 collides with an upper limit stopper 792, since the rotation of the hammer 76 is limited, it is impossible to depress the key 70 further. When the key 70 is depressed strongly, the hammer 76 (the weight 768) collides with the upper limit stopper 792, at which time an impact sound is generated. This impact sound may be transmitted to the key bed 58 via the frame 78. The inside of the electronic keyboard instrument 1 is not limited to the configuration shown in FIG. 3. The electronic keyboard instrument 1 may have, for example, a configuration in which the impact sound does not occur or a configuration in which the impact sound does not easily occur.

The detecting unit 75 described above includes a first sensor 75-1, a second sensor 75-2, and a third sensor 75-3. The first sensor 75-1, the second sensor 75-2, and the third sensor 75-3 are arranged between the frame 78 and the key 70. The first sensor 75-1, the second sensor 75-2, and the third sensor 75-3 are, for example, pressure sensitive switches. The first sensor 75-1, the second sensor 75-2, and the third sensor 75-3 are arranged at different positions in the depression area of the key 70 (from a rest position to an end position).

The first sensor 75-1, the second sensor 75-2, and the third sensor 75-3 output detection signals when detecting that the key 70 has passed through. Specifically, when the key 70 is depressed by the user, firstly, the first sensor 75-1 outputs a first detection signal KP1. When the key 70 is depressed further deeper, the second sensor 75-2 outputs a second detection signal KP2. When the key 70 is depressed further deeper, the third sensor 75-3 outputs a third detection signal KP3. On the other hand, when the depressed key 70 returns to the original position (the rest position), the output of the detection signal is stopped in the order of the third detection signal KP3, the second detection signal KP2, and the first detection signal KP1.

Figure 4:
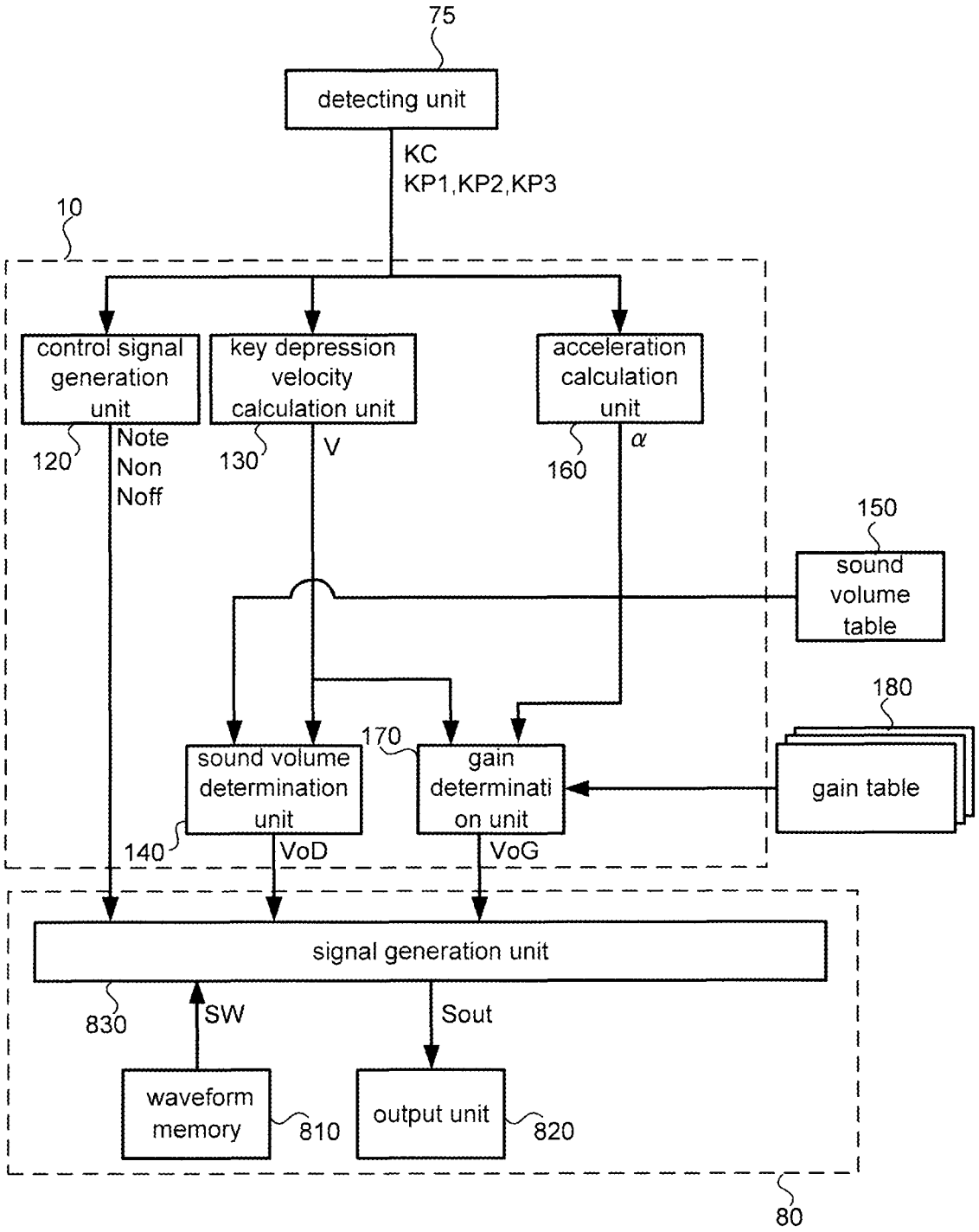
FIG. 4 is a block diagram showing a functional configuration of a control unit and a sound source in an embodiment of the present disclosure.

FIG. 4 is a block diagram showing a functional configuration of the control unit 10 and the sound source 80. The control unit 10 controls the sound source 80 based on a key number KC, the first detection signal KP1, the second detection signal KP2, and the third detection signal KP3 output from the detecting unit 75. The sound source 80 includes a waveform memory 810, an output unit 820, and a signal generation unit 830. The key number KC is a number assigned to each of the plurality of keys 70 so as not to overlap each other. The signal generation unit 830 reads waveform data SW from the waveform memory 810 to generate a sound signal Sout. The signal generation unit 830 outputs the sound signal Sout to the output unit 820. That is, the signal generation unit 830 is an exemplary generation unit that generates a sound signal to be output. The output unit 820 outputs the sound signal Sout to the speaker 60.

The waveform memory 810 stores a plurality of waveform data. The waveform data is, in the present embodiment, waveform data obtained by sampling sounds of the acoustic piano. The plurality of waveform data is the waveform data that is read when the key 70 is depressed and includes waveform data of the sounds including the string hitting sound and the key bed impact sound associated with key depressing. The waveform memory 810 stores a plurality of waveform data for each pitch of the string hitting sounds. The waveform data is associated with, for example, a note number assigned to each pitch of the string hitting sounds. The pitch of the string hitting sound varies depending on the note number. On the other hand, in the present embodiment, the pitch of the key bed impact sound is not varied by the note number. That is, the key bed impact sound is a common sound regardless of the note number.

Figure 5:
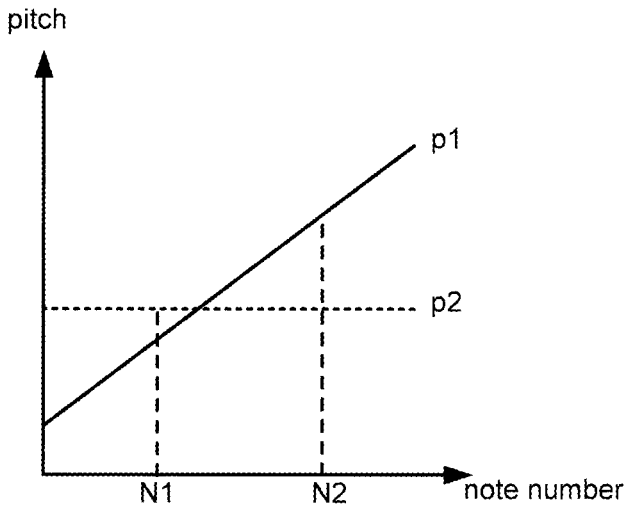
FIG. 5 is a diagram illustrating a relationship between pitches of a string hitting sound and pitches of an impact sound for respective note numbers in an embodiment of the present disclosure.

FIG. 5 is a diagram illustrating a relationship between the pitches of the string hitting sound and the pitch of the key bed impact sound corresponding to the respective note numbers. FIG. 5 shows a relationship between the note number and the pitch. FIG. 5 compares a pitch p1 of the string hitting sound with a pitch p2 of the key bed impact sound. When the note number changes, the pitch p1 of the string hitting sound varies. On the other hand, even if the note number changes, the pitch p2 of the impact sound does not vary. In other words, the pitch p1 of the string hitting sound differs between the case where the note number is N1 and the case where the note number is N2. On the other hand, the pitch p2 of the impact sound is the same in the case where the note number is N1 and the case where the note number is N2. The pitch p1 of the string hitting sound and the pitch p2 of the impact sound shown in FIG. 5 indicate tendencies of variation relative to the respective note number and do not indicate magnitude relationships with each other.

The control unit 10 includes a control signal generation unit 120, a key depression velocity calculation unit 130, a sound volume determination unit 140, an acceleration calculation unit 160, and a gain determination unit 170.

The control signal generation unit 120 generates a control signal that controls the sound generation based on the signal (the key number KC, the first detection signal KP1, the second detection signal KP2, and the third detection signal KP3) output from the detecting unit 75. In the present embodiment, the control signal is data in MIDI format, and includes a note number Note, a note on Non, and a note off Noff. The control signal generation unit 120 outputs the note on Non when the key 70 is depressed. Specifically, when the third detection signal KP3 is output from the detecting unit 75, the control signal generation unit 120 generates and outputs the note on Non. The control signal generation unit 120 determines the target note number Note based on the key number KC output corresponding to the third detection signal KP3.

The control signal generation unit 120 outputs the note off Noff when the depressed key 70 returns to the rest position. Specifically, after generating the note on Non, the control signal generation unit 120 generates and outputs the note off Noff when the output of the first detection signal KP1 of the corresponding key number KC is stopped.

The key depression velocity calculation unit 130 calculates key depression velocity V based on the signal provided by the detecting unit 75. The key depression velocity is velocity at which the key 70 is depressed and is an example of the first parameter. The key depression velocity calculation unit 130, for example, calculates the key depression velocity V based on the temporal difference of the output between the KP1 and the KP2.

The sound volume determination unit 140 determines sound volume VoD based on the key depression velocity V, referring to a sound volume table 150. The sound volume table 150 is stored in, for example, the storage unit 30. The sound volume table 150 is a table for specifying a relationship between the key depression velocity and the sound volume. The sound volume table 150 specifies, for example, a relationship in which the sound volume increases as the key depression velocity increases. The sound volume may increase linearly with increasing the key depression velocity, or may vary in a curvilinear manner (e.g., a curvilinear variation that is convex downward or convex upward). The sound volume determination unit 140 outputs the determined sound volume VoD to a signal generation unit 110.

The acceleration calculation unit 160 calculates a key depression acceleration $\alpha$ based on the signal output from the detecting unit 75. The key depression acceleration $\alpha$ is an acceleration when the key 70 is depressed is an exemplary second parameter. When the key depression acceleration is a positive value, it indicates that the key 70 is gradually accelerating while being depressed. When the key depression acceleration is a negative value, it indicates that the key is gradually decelerating while being depressed. The acceleration calculation unit 160 calculates, for example, the key depression acceleration $\alpha$ based on the temporal difference between the output of the KP1 and the KP2 and the temporal difference between the output of the KP2 and the KP3. Both the key depression velocity V and the key depression acceleration $\alpha$ are parameters according to displacements of the key 70. The key depression velocity V and the key depression acceleration $\alpha$ are calculated by different calculation methods.

Figure 6:
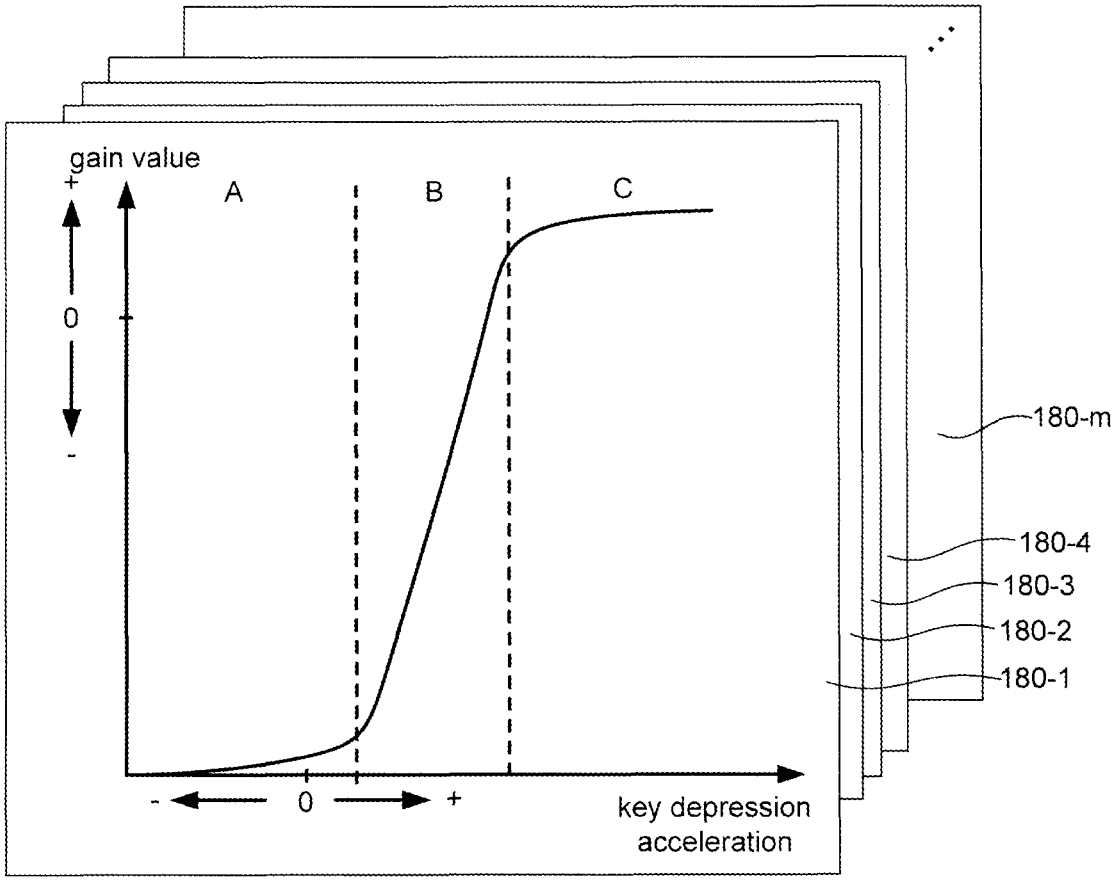
FIG. 6 is a diagram exemplifying a configuration of a gain table group according to an embodiment of the present disclosure.

The gain determination unit 170 refers to one gain table selected from a gain table group 180 to determine a gain value VoG corresponding to the key depression acceleration $\alpha$. The gain table group 180 is stored in, for example, the storage unit 30. FIG. 6 is a diagram exemplifying a configuration of the gain table group 180. The gain table group 180 includes gain tables 180-1, 180-2, 180-3, 180-4, . . . , **180-*m* (where m is a natural number). The gain tables 180-1, 180-2, 180-3, 180-4, . . . , and 180-*m* are tables for specifying the relationship between the key depression acceleration and the gain value, respectively. The gain tables 180-1, 180-2, 180-3, 180-4, . . . , 180-*m* correspond to the different key depression velocities. That is, the gain determination unit 170 selects the gain table corresponding to the key depression velocity V from among the gain table group 180. The gain determination unit 170 outputs the gain value VoG to the signal generation unit 830. The signal generation unit 830 generates the sound signal Sout based on the parameters supplied from each of the control signal generation unit 120, the sound volume determination unit 140, and the gain determination unit 170**.

An exemplary relationship between the key depression acceleration and the gain value will be described. For the gain table 180-1 shown in FIG. 6, in an area A including an area where the key depression acceleration is a negative value or near zero, the gain value takes a relatively large value in the negative direction. In the area A, the variation in the gain value relative to the variation in the key depression acceleration is relatively small. In an area B where the key depression acceleration is larger in the positive direction than the area A, the variation in the gain value in the positive direction relative to the variation in the key depression acceleration in the positive direction is larger than the area A. In the example of FIG. 6, the gain value is generally linearly increased with increasing the key depression acceleration in the area B but is not limited to this relationship. The gain value is positive in an area C where the key depression acceleration in the positive direction is larger than the area B. In the area C, the variation in the gain value relative to the variation in the key depression acceleration is smaller than in the area B.

Each of the gain tables 180-2, 180-3, 180-4, . . . , and **180-*m* specifies the relation between the key depression acceleration and the gain value, which has the same tendency as the gain table 180-1**, but the relation between the specific values differs.

Figure 7:
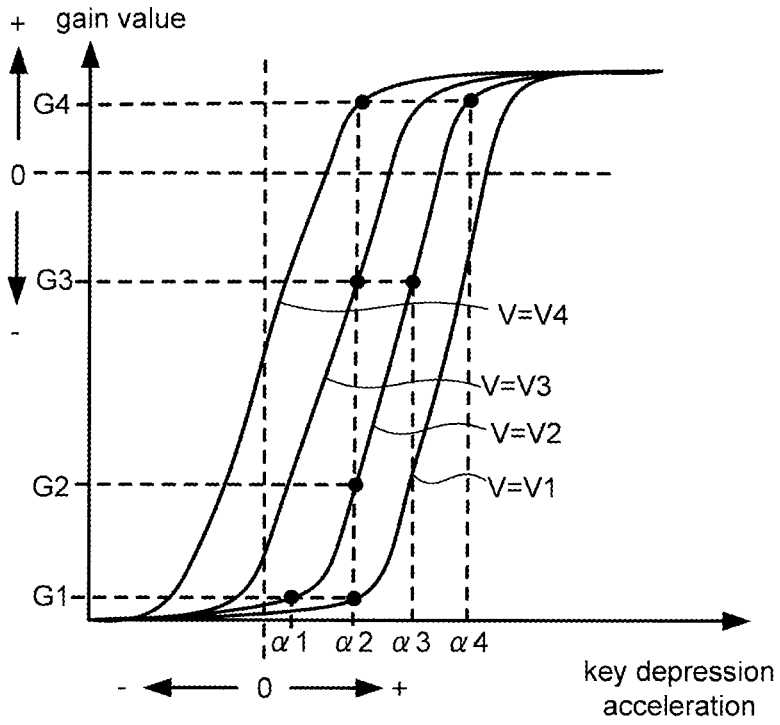
FIG. 7 is a graph exemplifying a relationship between key depression acceleration and gain values for a plurality of key depression velocities in an embodiment of the present disclosure.

FIG. 7 is a graph exemplifying a relationship between the key depression acceleration and the gain value for the key depression velocities V1, V2, V3, and V4. Here, the key depression velocity is higher in the order of the key depression velocities V4, V3, V2, and V1. As shown in FIG. 7, typically, the gain value relative to the key depression acceleration is greater at greater key depression velocity. For example, when the key depression acceleration is α2 shown in FIG. 7, the gain values in the cases of the key depression velocities V1, V2, V3, and V4 are G1, G2, G3, and G4, respectively (where G4>G3>G2>G1).

Figure 8:
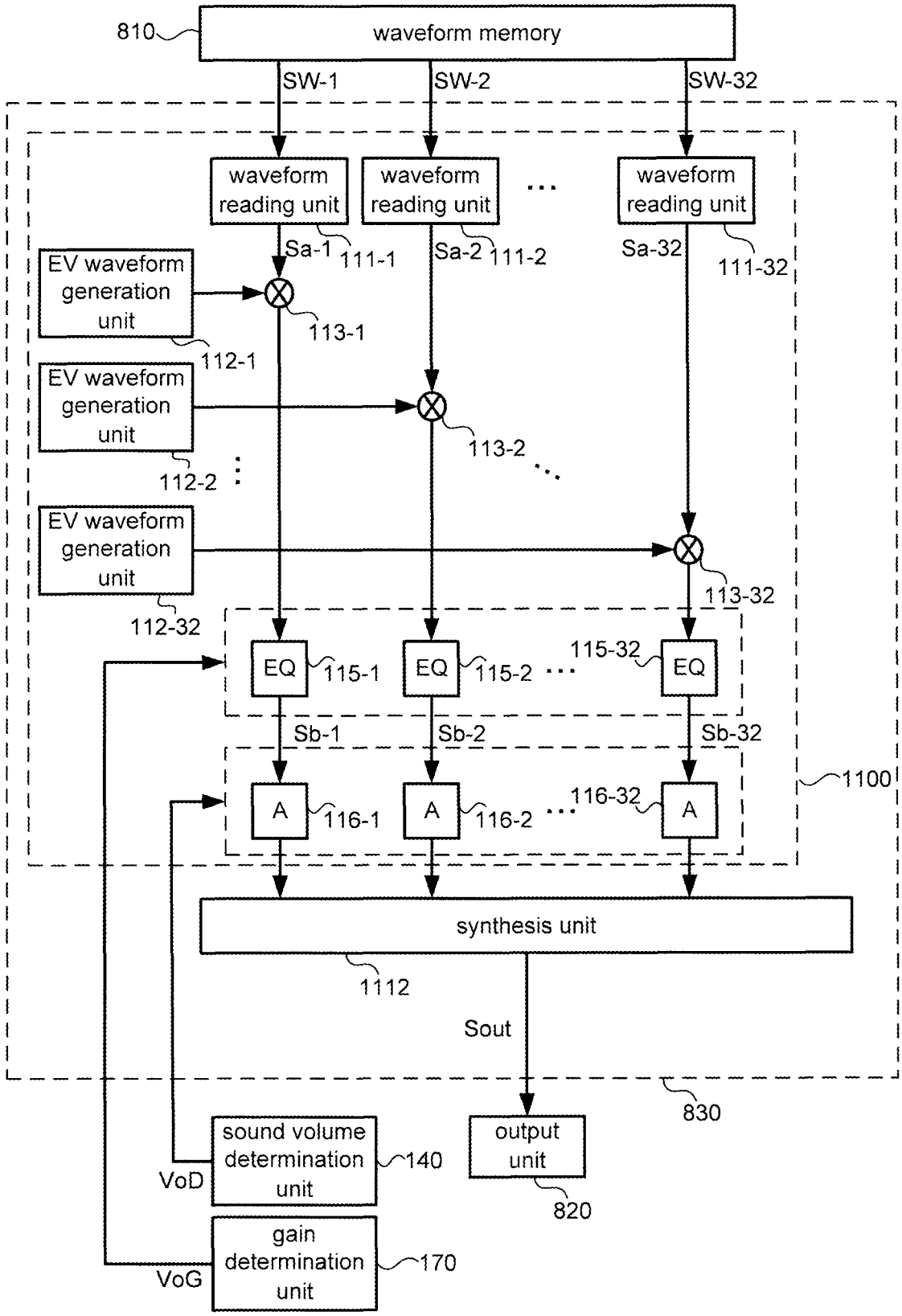
FIG. 8 is a diagram exemplifying a functional configuration of a signal generation unit according to an embodiment of the present disclosure.

FIG. 8 is a block diagram exemplifying a functional configuration of the signal generation unit 830. The signal generation unit 830 includes a sound signal generation unit 1100 and a synthesis unit 1112. The sound signal generation unit 1100 generates the sound signal based on the signal output from the detecting unit 75. The synthesis unit 1112 synthesizes the sound signal generated in the sound signal generation unit 1100 and outputs it as the sound signal Sout.

The sound signal generation unit 1100 has a waveform reading unit 111 (waveform reading unit **111-*k*, k=1 to n), an EV (envelope) waveform generation unit 112 (EV waveform generation unit 112-*k*; k=1 to n), a multiplier 113 (multiplier 113-*k*; k=1 to n), an equalizer (EQ) 115 (equalizer 115-*k*; k=1 to n), and an amplifier 116 (116-*k*; k=1 to n). The above "n" corresponds to the number of sounds that can be emitted simultaneously (i.e., the number of sound signals that can be generated simultaneously) and is "32" in this example. That is, according to the sound signal generation unit 1100**, when the state that the sound up to 32 times of the key depression being generated is maintained and when there is a 33rd key depression in a state in which all are sounded, the sound signal corresponding to the first sound generation is forcibly stopped.

The waveform reading unit 111-1 identifies and reads out waveform data SW-1 to be read from a waveform memory 161 based on the control signal (e.g., the note on Non) obtained from the control signal generation unit 120, the note number Note, and the key depression velocity V. The waveform reading unit 111-1 outputs a sound signal Sa-1 based on the waveform data SW-1 to the multiplier 113-1. The sound signal Sa-1 is an exemplary first sound signal.

The EV waveform generation unit 112-1 generates an envelope waveform based on the control signal obtained from the control signal generation unit 120 and the preset parameter. For example, the envelope waveform is identified by parameters of attack level, attack time, decay time, sustain level and release time.

The multiplier 113-1 multiplies the sound signal Sa-1 output from the waveform reading unit 111-1 by the envelope waveform generated in the EV waveform generation unit 112-1 and outputs it to the equalizer 115-1.

The equalizer 115-1 carries out gain adjustment based on the gain value VoG set by the gain determination unit 170 to generate a sound signal Sb-1. In the present embodiment, the gain adjustment is a process of changing the level of a portion of a band of the sound signal (frequency band). The equalizer 115-1 outputs the sound signal Sb-1 to the amplifier 116-1.

Figure 9:
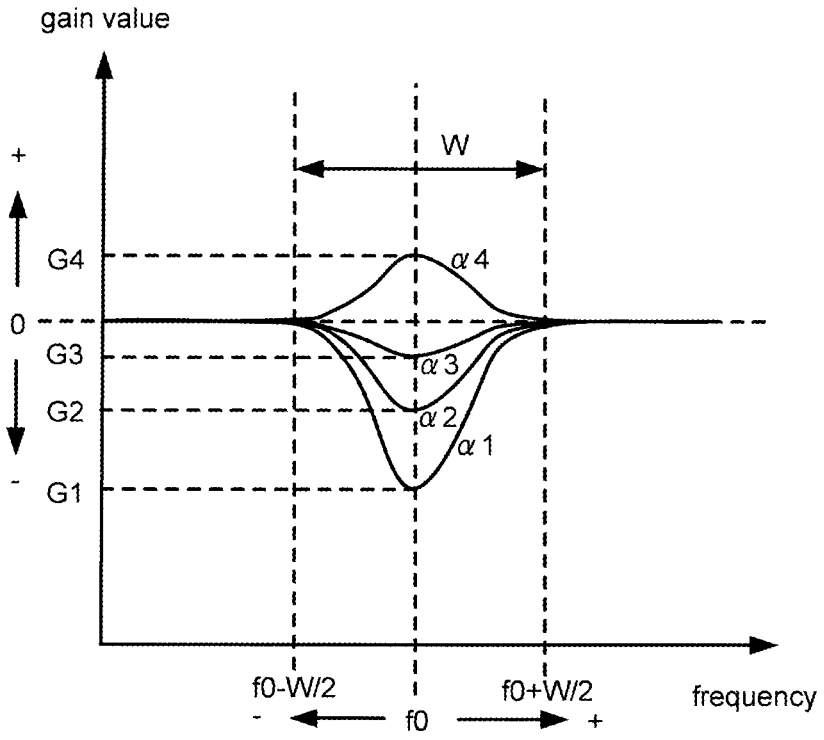
FIG. 9 is a diagram exemplifying a processing of an equalizer in an embodiment of the present disclosure.

FIG. 9 is a diagram exemplifying a processing of the equalizer 115-1. FIG. 9 is a graph showing the relationship between the frequency [Hz] of the sound signal and the gain value [dB] (decibel) used for the gain adjustment. In FIG. 9, the gain value corresponding to each of the cases where the acceleration when the key depression velocity V2 shown in FIG. 7 is α1, α2, α3, α4 respectively are shown. When the gain value is zero, it means that the gain of the sound signal does not vary, that is, the level of the frequency (i.e. sound pressure) of that sound signal does not vary. If the gain value is positive, it means that the level of the frequency of that sound signal is raised, and the larger the value, the higher the level. When the gain value is negative, it means that the level of the frequency of that sound signal is lowered, and the larger the value, the lower the level.

As shown in FIG. 9, the equalizer 115-1 varies the level in a band of width W centered at frequency f0 (i.e., f0−W/2 to f0+W/2). The gain value VoG indicates the gain value at frequency f0. In the example of FIG. 9, at frequency f0, the gain value G1 is used when the key depression acceleration is α1, the gain value G2 is used when the key depression acceleration is α2, the gain value G3 is used when the key depression acceleration is α3, the gain value G4 is used when the key depression acceleration is α4. The gain value in the band varies smoothly and becomes zero at frequency f0−W/2 and f0+W/2.

Frequency f0 is, for example, a frequency that belongs within a range of 150 Hz to 200 Hz. Frequency f0 matches the frequency component of the key bed impact sound. Therefore, as the gain value VoG is larger, the gain adjustment for relatively emphasizing the key bed impact sound is performed, and on the contrary, as the gain value VoG is smaller, the gain adjustment for relatively weakening the key bed impact sound is performed. As shown in FIG. 9, the reason why the gain value VoG takes a negative value over a wide range of the key depression acceleration is to reproduce the intensity of the key bed impact sound based on the component of the key bed impact sound contained in the waveform data SW-1 (the sound signal Sa-1).

The amplifier 116-1 amplifies the sound signal Sb-1 according to the set amplification factor and outputs it to the synthesis unit 1112. The amplification factor is set based on the sound volume VoD determined in the sound volume determination unit 140. The amplifier 116-1 adjusts the output level of the sound signal based on the sound volume VoD.

Although the case of k=1 (k=1 to n) is exemplified, each time the next key 70 is depressed while the string hitting sound waveform data SW-1 is being read from the waveform reading unit 111-1, the control signal obtained from the control signal generation unit 120 is applied in the order of k=2, 3, 4, . . . . For example, if the next key is depressed, the control signal is applied to the configuration corresponding to k=2, that is, the waveform reading unit 111-2 reads a waveform data SW-2 and outputs the sound signal Sa-2 (the first sound signal) to the multiplier 113-2. And then, the equalizer 115-2 adjusts the gain of the sound signal from the multiplier 113-2 and generates a sound signal Sb-2. If the key is depressed next, the control signal is applied to the configuration corresponding to k=3. That is, when the control signal is applied to the configuration corresponding to k=i (where 1≤i≤32), the waveform reading unit **111-*i* reads a waveform data SW-i, and outputs the sound signal Sa-i (the first sound signal) to the multiplier 113-*i***. The equalizer 115-*i* adjusts the gain of the sound signal from the multiplier 113-*i* and generates a sound signal Sb-i. In other words, when the plurality of keys 70 are depressed, the signal generation unit 110 outputs a sound signal for each specified note number corresponding to each key 70.

The synthesis unit 1112 synthesizes the sound signal output from the sound signal generation unit 1100 and outputs it as the sound signal Sout to the output unit 820. The sound signal Sout is an exemplary second sound signal. The configuration of the sound source 80 has been described above.

Figure 10:
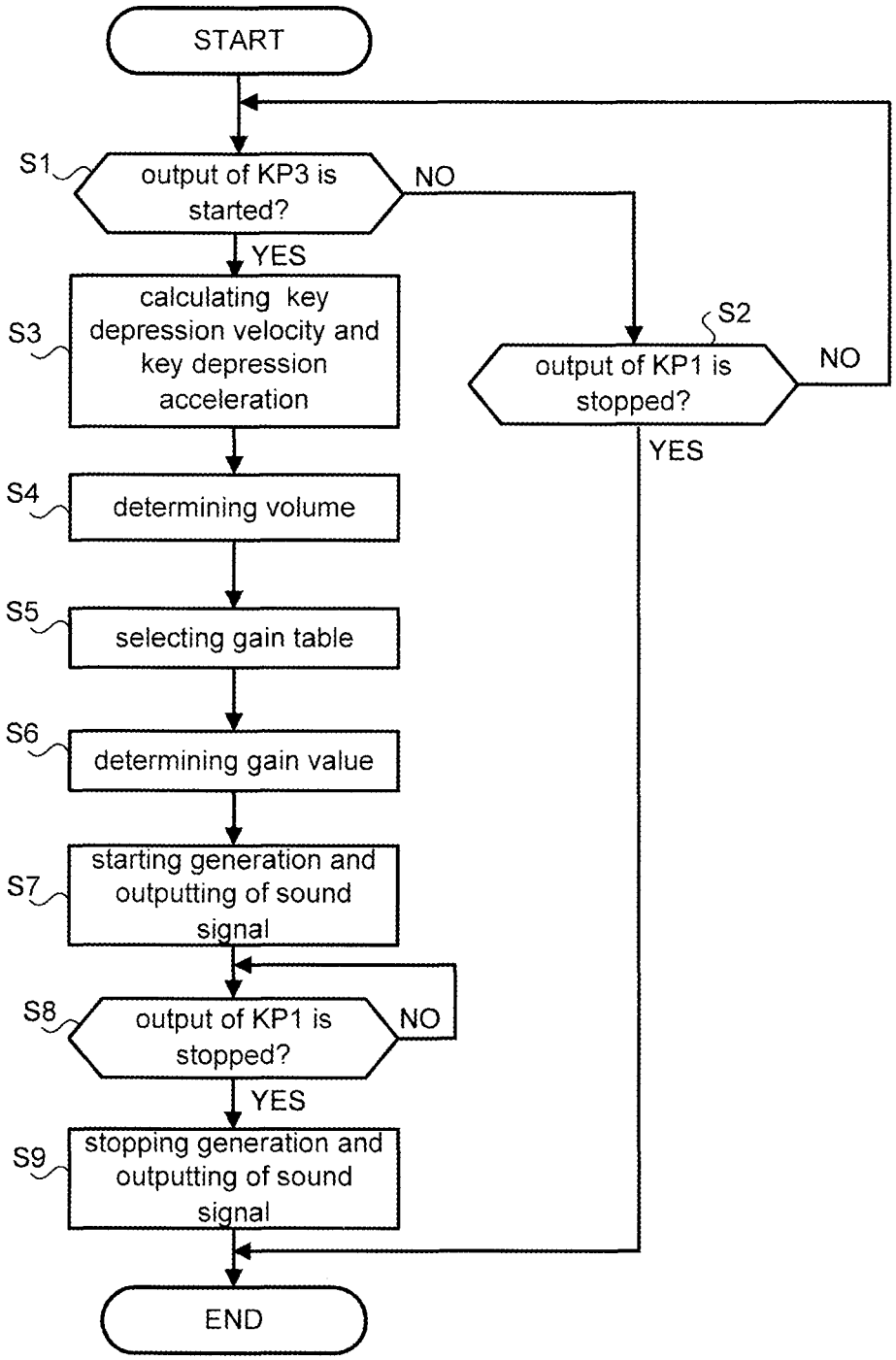
FIG. 10 is a flow chart showing a control by a control unit in an embodiment of the present disclosure.

FIG. 10 is a flow chart showing control by the control unit 10. The processing of FIG. 10 is executed for each key number KC (the note number Note) by the control unit 10. For example, when the first detection signal KP1 is output, the control unit 10 starts processing corresponding to the key number KC corresponding to the output. First, the control unit 10 waits until the output of the third detection signal KP3 is started or the output of the first detection signal KP1 is stopped (step S1: NO, step S2: NO). In the steps S1 and S2, the control unit 10 determines whether any one of the keys 70 has been depressed down to a sound generation start position. When the output of the first detection signal (KP1) is stopped (step S2: YES), the processing of FIG. 10 ends.

If it is determined that "YES" in the step S1, the control unit 10 calculates the key depression velocity V from the temporal difference between the output timing of the third detection signal KP3 and the output timing of the second detection signal KP2 and calculates the key depression acceleration $\alpha$ from the temporal difference of the output timing between the first detection signal KP1, the second detection signal KP2, and the third detection signal KP3 (step S3). Next, the control unit 10 determines the volume associated with the key depression velocity V to the sound volume VoD, referring to the sound volume table 150 (step S4).

Next, the control unit 10 selects one gain table corresponding to the key depression velocity V from the gain table group 180 (step S5). Next, the control unit 10 determines the gain value associated with the key depression acceleration $\alpha$ in the selected gain table to the gain value VoG (step S6). Next, the control unit 10 causes the sound source 80 to start generation and output of the sound signal (i.e., sound generation) (step S7). In the step S7, the control unit 10 sets a sound generation state flag ST stored in, for example, the RAM 13 or the storage unit 30 to "1", generates the note on Non, and outputs the note on Non to the sound source 80. In response to the note on Non, the sound source 80 reads out the note number Note corresponding to the key 70 in which the outputting of the third detection signal KP3 is started and the waveform data SW identified by the key depression velocity V from the waveform memory 810. The sound source 80, based on the gain value VoG, carries out the gain adjustment of the sound signal generated based on the waveform data SW. The sound source 80 amplifies the sound signal generated by the gain adjustment with an amplification factor corresponding to the sound volume VoD, and outputs the sound signal Sout to the speaker 60.

Next, the control unit 10 determines whether the output of the first detection signal KP1 has stopped (step S8). The step S8 may be a processing for determining whether or not the sound generation state flag ST is "1" and the state in which the first detection signal is being output continues. If it is determined "NO" in the step S8, it means that the depressed state continues after any one of the keys 70 is depressed down to the sound generation start position. Therefore, during the period determined as "NO" in the step S8, the sound source 80 outputs the sound signal identified by the key number KC of the key 70 to the speaker 60 to continue the sound generation. Here, since no key bed impact sound is generated, the sound source 80 generated a sound that does not contain the component of the key bed impact sound. The sound source 80 may, for example, loop output a portion of the waveform data of the sound that does not include the component of the key bed impact sound, or store the waveform data of the sound that does not contain the component of the key bed impact sound in the waveform memory 810, and output the sound signal generated based on the waveform data to the speaker 60.

If it is determined that "YES" in the step S8, the control unit 10 makes the sound source 80 to stop generating and outputting of the sound signal (step S9). In the step S9, the control unit 10 resets the sound generation state flag ST to "0", for example, and generates and outputs the note off Noff to the sound source 80. If it is determined "YES" in the step S8, it means that the operation of the key 70 has reached a sound stop start position. Depending on the note off Noff, the sound source 80 changes the envelope to multiply the waveform data to release waveform. Then, the sound source 80 performs an envelope processing for multiplying the envelope waveform to the read waveform data, and outputs a sound signal. Also, in this case, since the key bed signal impact sound is not generated, the same processing as that in the period determined as "NO" in the step S8 is performed. Known ADSR (Attack, Decay, Sustain, Release) control is applied to the envelope processing. When the control unit 10 stops the sound generation by the sound source 80 by the processing of S9, the processing of FIG. 10 ends.

As described above, according to the electronic keyboard instrument 1, the waveform data of the sound including the string hitting sound and the key bed impact sound is stored in the waveform memory 810, and when the key 70 is depressed, the gain adjustment is carried out to adjust the level of the component corresponding to the key bed impact sound. For example, when the key 70 is depressed strongly, the gain adjustment is carried out to emphasize the component corresponding to the key bed impact sound relatively, and when the key 70 is depressed weakly, the gain adjustment is carried out to weaken the component corresponding to the key bed impact sound relatively, or not generate a sound based on the component corresponding to the key bed impact sound. As a result, the electronic keyboard instrument 1 can emit sounds that reproduce the string hitting sound and the key bed impact sound, which vary depending on the operation, without storing the waveform obtained by sampling the string hitting sound and the key bed impact sound in advance for each sound.

Although an embodiment of the present disclosure has been described above, an embodiment of the present disclosure may also be modified into various forms as follows. The exemplary embodiment described above, and the modifications described below can be applied in combination with each other.

The control unit 10 may determine the gain value VoG corresponding to the operated key 70 (in other words, the note number). That is, the sound source 80 varies the magnitude of the variation of the level in the gain adjustment between one key 70 (first operator) and another key 70 (second operator).

For example, when lowering the level of the sound signal in a band around approximately 100 Hz, the sound of the low range may be reduced. Therefore, the sound source 80 does not carry out the gain adjustment in the sound range below a predetermined pitch, or takes the gain value as a value the positive direction of the sound range higher than the predetermined pitch. Specifically, the gain determination unit 170 may determine a value obtained by multiplying the gain value identified based on the gain table by a weight value corresponding to the operated key 70 as the gain value VoG.

Figure 11:
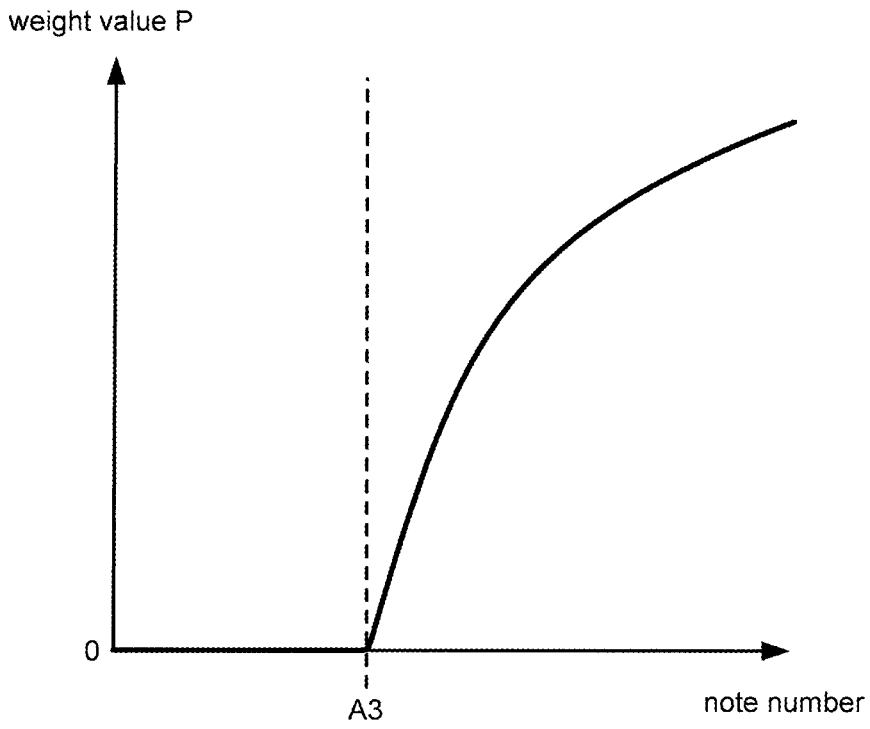
FIG. 11 is a graph exemplifying a relationship between pitch and weight values in a modification of the present disclosure.

FIG. 11 is a graph exemplifying a relationship between the note number and a weight value P. As shown in FIG. 11, the weight value P is zero in the sound range below the predetermined note number (here, A3). That is, when the weight value P is zero, the gain value VoG is zero. Therefore, the level in the gain adjustment by the equalizer 115 does not vary, so that substantially no gain adjustment is carried out.

On the other hand, in the sound range higher than the predetermined note number (here, A3), the weight value P is a positive value. Here, the weight value P is larger as the pitch is higher. In FIG. 11, the weight value P increases in an upward convex curve manner but may increase in a downward convex curve manner or may increase in a linear manner, for example. As a result, the string hitting sound and the key bed impact sound are generated in the relatively high sound range, and the deterioration of the quality of the string hitting sound is suppressed in the low sound range.

The sound source 80 (the equalizer 115) may vary the gain value corresponding to a certain key depression acceleration in time. The sound source 80, for example, may expand or contract the width W for the gain adjustment, to the passage of time while keeping the center frequency f0 as the center.

Part of the configuration and operation of the embodiment described above may be omitted or changed. For example, the sound source 80 may determine the gain value only by key depression acceleration without changing the gain value depending on the key depression velocity. In the embodiment described above, the sound source 80 determines the sound volume based on the sound volume table 150 and determines the gain value based on the gain table. Not limited to the method of referring to the tables, for example, the sound source 80 may determine the sound volume or the gain value by a calculation by a predetermined calculation formula. In addition, the synthesis unit 1112 may be omitted. That is, the sound signal Sout may be a sound signal at least carried out the gain adjustment.

The first sensor 75-1, the second sensor 75-2, and the third sensor 75-3 may be a magnetic sensor, a capacitive sensor, or other sensor in place of the pressure sensitive switches. The method of obtaining the key depression velocity and the key depression acceleration are not limited to the method detected by using the first sensor 75-1, the second sensor 75-2, and the third sensor 75-3.

Figure 12:
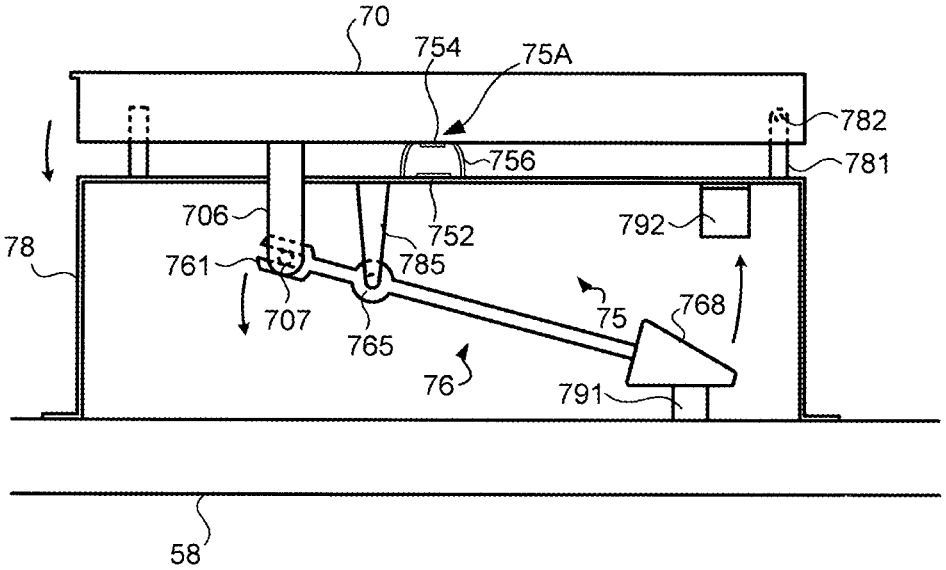
FIG. 12 is a diagram showing an internal configuration of an electronic keyboard instrument (key assembly) according to a modification of the present disclosure.

The electronic keyboard instrument 1 may use a sensor that continuously detects the position of the key 70. FIG. 12 is a diagram showing the configuration of the inside of the electronic keyboard instrument (keyboard assembly) in one modification. In this example, the electronic keyboard instrument detects an operation of the hammer by a stroke sensor 75A. The stroke sensor 75A corresponds to the detecting unit 75 in the first embodiment and configured by a sensor unit 752, a reflecting portion 754, and a wall 756. On the upper surface of the upper plate portion of the frame 78, the sensor unit 752 for emitting and receiving light is provided. On a portion of a lower surface of the key 70 facing the sensor unit 752, the reflecting portion 754 for reflecting light emitted from the sensor unit 752 is provided. Between the lower surface of the key 70 and the upper surface of the upper plate portion, the wall 756 is provided to surround the periphery of the sensor unit 752 and the reflecting portion 754. The wall 756 is a member for preventing external light from entering the sensor portion 752 and formed of a flexibility material such as a soft rubber.

Light emitted from the sensor unit 752 is reflected by the reflecting portion 754, the reflected light is received by the sensor unit 752. When the key 70 is lowered by the key depression operation, the distance between the sensor unit 752 and the reflecting portion 754 is reduced, and the amount of light received by the sensor unit 752 is increased. That is, the amount of light received by the sensor unit 752 varies continuously as the position of the key 70 changes. The sensor unit 752 outputs an electric signal corresponding to the amount of light received to an A/D converter (not shown), a signal converted into digital data by the A/D converter is output to the key depression velocity calculation unit 130 and the acceleration calculation unit 160.

A sensor may be provided on each of the hammers 76 (interlocking member) interlocked with the corresponding key 70, and the sound source 80 may calculate the key depression velocity V and the key depression acceleration $\alpha$ based on the signals output from the respective sensors. That is, the key depression velocity may be either the velocity of the key 70 or the velocity of the part that moves along with the movement of the key 70. The key depression acceleration may be either the acceleration of the key 70 or the acceleration of the part that moves along with the movement of the key 70.

In the embodiment described above, the acoustic instrument for sound sampling is an acoustic piano but may be an acoustic instrument such as a celesta, a cembalo (a harpsichord), a glockenspiel and the like or a wind musical instrument. The present disclosure is applicable to electronic instruments other than the electronic keyboard instrument. In an electronic instrument, the operator for indicating sound generation is the operator that is displaced in response to the operation.

The first and second parameters may be parameters other than velocity, acceleration, respectively. The first parameter and the second parameter may be parameters calculated by different calculation methods based on the displacement of the key 70. The second parameter may be a variation of the velocity of the key 70, for example, a velocity ratio between the movement of the first half of the key 70 and the movement of the second half, rather than the acceleration.

In the embodiment described above, the key 70 and the sound source 80 are configured as an integral instrument in the housing 50 in the electronic keyboard instrument 1, but they may be configured separately. In this case, for example, the sound source 80 may acquire a detection signal from a plurality of sensors in the detecting unit 75 via the interface for connecting with the external device, or may acquire the detection signal from the data recorded such detection signal in time series.

The key bed impact sound emitted by the electronic keyboard instrument 1 is a common sound regardless of the note number, but it may be different within a certain frequency band (e.g., within the range between the frequency f0−W/2 and f0+W/2) depending on the pitch or depending on the predetermined sound range. In this case, the equalizer 115 changes the gain adjustment in the frequency band depending on the pitch or a predetermined sound range.

In the embodiment described above, the sound source 80 is generated the sound signal based on the waveform data read from the waveform memory, but it may be obtained the waveform (sound signal) data to be processed by another method. For example, the waveform data (sound signal) may be acquired by physical model operations as disclosed in Japanese Patent No. 5664185.

The order of execution of the processing shown in FIG. 10 is merely an example. For example, the control unit 10 may determine the sound volume VoD after selecting the gain table and determining the gain value VoG.

The sound source 80 may have some of the functions of the control unit 10 described in the above embodiment. For example, the sound source 80 may have the key depression velocity calculation unit, the sound volume determination unit, the acceleration calculation unit or the gain determination unit. The control unit 10 may have some of the functions of the sound source 80 described in the above embodiment. For example, the ROM 12 of the control unit 10 may function as the waveform memory.

When the functions of the control unit 10 or the sound source 80 described above are realized by using the programs, the programs may be provided in the form of being stored in a computer-readable non-transitory recording medium such as a magnetic recording medium (a magnetic tape, a magnetic disk, etc.), an optical recording medium, a magneto-optical recording medium, a semi-conductor memory, etc., or may be distributed via a network. The present disclosure can also be understood as an invention of a signal processing method which can be realized by a computer.

The present disclosure is not limited to the above-described embodiments and can be appropriately modified within a range not departing from the spirit.

The invention claimed is:

1. A signal processing device comprising:

at least one memory storing executable instructions; and a processor that executes the executable instructions stored in the at least one memory to:

obtain a first parameter corresponding to a displacement of an operator among a plurality of operators;

identify a first sound signal based on the first parameter corresponding to the displacement of the operator;

obtain a second parameter corresponding to the displacement of the operator among the plurality of operators, the second parameter being different from the first parameter; and cause a sound generator to generate a second sound signal by varying a level of a portion of a frequency band of the first sound signal, identified based on the first parameter corresponding to the displacement of the operator, based on the second parameter corresponding to the displacement of the operator.

2. The signal processing device according to claim 1, wherein the processor executes the executable instructions stored in the at least one memory to calculate the first parameter and the second parameter based on the displacement of the operator.

3. The signal processing device according to claim 1, wherein the first parameter is a velocity of the operator.

4. The signal processing device according to claim 1, wherein the second parameter is an acceleration of the operator.

5. The signal processing device according to claim 1, wherein a variation of the level of the portion of the frequency band of the first sound signal corresponding to a first operator among the plurality of operators and a variation of the level of the portion of the frequency band of the first sound signal corresponding to a second operator among the plurality of operators are different from each other.

6. The signal processing device according to claim 1, wherein the processor executes the executable instructions stored in the at least one memory to cause the sound generator to generate the second sound signal by varying the level of the portion of the frequency band of the first sound signal based on both of the first parameter and the second parameter.

7. The signal processing device according to claim 1, wherein each of the plurality of operators is a key.

8. The signal processing device according to claim 5, wherein the first operator is a first key, and the second operator is a second key different from the first key.

9. A signal processing method comprising:

obtaining a first parameter corresponding to a displacement of an operator among a plurality of operators;

identifying a first sound signal based on the first parameter corresponding to the displacement of the operator;

obtaining a second parameter corresponding to the displacement of the operator among the plurality of operators, the second parameter being different from the first parameter; and generating a second sound signal by varying a level of a portion of a frequency band of the first sound signal, identified based on the first parameter corresponding to the displacement of the operator, based on the second parameter corresponding to the displacement of the operator.

10. The signal processing method according to claim 9, further comprising calculating the first parameter and the second parameter by different calculation methods from each other based on the displacement of the operator.

11. The signal processing method according to claim 9, wherein the first parameter is a velocity of the operator.

12. The signal processing method according to claim 9, wherein the second parameter is an acceleration of the operator.

13. The signal processing method according to claim 9, wherein a variation of the level of the portion of the frequency band of the first sound signal corresponding to a first operator among the plurality of operators and a variation of the level of the portion of the frequency band of the first sound signal corresponding to a second operator among the plurality of operators are different from each other.

14. The signal processing method according to claim 9, wherein the second sound signal is generated by varying the level of the portion of the frequency band of the first sound signal based on both of the first parameter and the second parameter.

15. The signal processing method according to claim 9, wherein the portion of the frequency band of the first sound signal is a frequency band within a range of 150 Hz or more to 200 Hz or less.

16. The signal processing method according to claim 9, wherein each of the plurality of operators is a key.

17. The signal processing method according to claim 16, wherein:

the second parameter is an acceleration of the key, and the second sound signal is generated by varying the level of the portion of the frequency band of the first sound signal such that (i) the level is varied by a first amount in a case where the acceleration of the key is a first acceleration and (ii) the level is varied by a second amount less than the first amount in a case where the acceleration of the key is a second acceleration less than the first acceleration.

18. The signal processing method according to claim 9, wherein the second sound signal is generated by varying the level of the portion of the frequency band of the first sound signal based on the second parameter and a note number of the operator.

19. A sound generator comprising:

a first parameter obtaining unit configured to obtain a first parameter corresponding to a displacement of an operator among a plurality of operators;

an identification unit configured to identify a first sound signal based on the first parameter corresponding to the displacement of the operator;

a second parameter obtaining unit configured to obtain a second parameter corresponding to the displacement of the operator among the plurality of operators, the second parameter being different from the first parameter; and an output unit configured to output a second sound signal by varying a level of a portion of a frequency band of the first sound signal, identified based on the first parameter corresponding to the displacement of the operator, based on the second parameter corresponding to the displacement of the operator.

20. A signal processing method comprising:

outputting a second sound signal by varying a level of a portion of a frequency band of a first sound signal based on a second parameter corresponding to a displacement of one of a plurality of operators, the first sound signal being identified by a first parameter corresponding to the displacement of the one of the plurality of operators, the second parameter being different from the first parameter.

* * * * *